US005862857A

United States Patent [19]

Ishikawa et al.

[11] Patent Number: 5,862,857

[45] **Date of Patent: *Jan. 26, 1999**

[54] HEAT EXCHANGER FOR REFRIGERATING CYCLE

[75] Inventors: Atsuyumi Ishikawa; Masahiro Kobayashi, both of Ota; Masanori Akutsu, Isesaki; Takashi Kawanabe; Masayuki Motegi, both of Oizumi, all of Japan

[73] Assignee: Sanyo Electric Co., Ltd, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 680,264

[22] Filed: Jul. 11, 1996

[30] Foreign Application Priority Data

Jul. 12, 1995 [JP] Japan ..... 7-200460
Aug. 25, 1995 [JP] Japan ..... 7-240877

[51] Int. Cl.[6] ..... F28F 1/14

[52] U.S. Cl. ..... 165/184; 165/179; 165/133

[58] Field of Search ..... 165/133, 179, 165/184, 183; 62/513

[56] References Cited

U.S. PATENT DOCUMENTS

| | | | |
|---|---|---|---|
| 4,503,907 | 3/1985 | Tanaka et al. | 165/133 |
| 4,705,103 | 11/1987 | Zogg et al. . | |
| 4,781,738 | 11/1988 | Fujiwara et al. | 62/18 |
| 4,926,650 | 5/1990 | Dawn et al. | 62/114 |
| 5,052,476 | 10/1991 | Sukumoda et al. . | |
| 5,079,087 | 1/1992 | Lever et al. | 165/133 X |
| 5,137,067 | 8/1992 | Espeut | 165/133 |
| 5,470,431 | 11/1995 | Okuda et al. | 165/133 X |
| 5,514,478 | 5/1996 | Nadkarni | 165/133 X |
| 5,545,438 | 8/1996 | Ouyang et al. | 165/133 X |
| 5,562,949 | 10/1996 | Steele et al. | 165/133 X |
| 5,582,024 | 12/1996 | Kobor | 165/133 X |

FOREIGN PATENT DOCUMENTS

| | | | |
|---|---|---|---|
| 56-117097 | 9/1981 | Japan . | |
| 57-175896 | 10/1982 | Japan . | |
| 0083190 | 5/1983 | Japan | 165/179 |
| 58-208593 | 12/1983 | Japan . | |
| 0172893 | 7/1988 | Japan | 165/179 |
| 02097896 | 4/1990 | Japan . | |
| 3234302 | 10/1991 | Japan | 165/184 |
| 6147532 | 5/1994 | Japan | 165/179 |
| 1677481 | 9/1991 | U.S.S.R. | 165/184 |
| 9029661 | 12/1994 | WIPO | 165/184 |

*Primary Examiner*—Ira S. Lazarus
*Assistant Examiner*—Christopher Atkinson
*Attorney, Agent, or Firm*—Darby & Darby

[57] ABSTRACT

A heat exchanger used for a refrigerating cycle has a plurality of grooves formed in the inner surface of a pipe thereof in the flowing direction of a refrigerant. At least two types of grooves which differ in width are used. The pipe also has fins which are coated with a hydrophilic paint that is black in color. This design enables the heat exchanger to provide improved performance.

3 Claims, 5 Drawing Sheets

HEAT EXCHANGER FOR REFRIGERATING CYCLE

BACKGROUND OF THE INVENTION

1. Field of the Invention

The present invention relates to a heat exchanger used for a refrigerating cycle composed of a compressor, etc.

2. Description of the Related Art

Hitherto, a heat exchanger used for the electric equipment for refrigeration or air conditioning (such as an air conditioner, a freezer, and a cooled showcase) is constructed with a refrigerant pipe which forms a refrigerating cycle and has a plurality of fins as disclosed in, for example, Japanese Patent Publication No. 4-16711 (F28G9/00).

The fins are designed to pen-it efficient dissipation or absorption of heat between the refrigerant, which flows through the refrigerant pipe, and air. They are usually made of aluminum sheet which is approximately 100 to 120 microns thick.

When such a heat exchanger is used as a condenser for a refrigerating cycle, for example, a gas refrigerant of high temperature and high pressure which is discharged from a compressor flows into the heat exchanger, causing the temperature thereof to go up to approximately +20 to +100 degrees centigrade. The heat of the refrigerant is transferred from the refrigerant pipe wall of the heat exchanger or the condenser to the fins and it is radiated into the air from the surfaces of the fins, a part thereof being radiated from the surfaces of the refrigerant pipe.

The refrigerant radiates heat and condenses from such heat radiation. The surfaces of the fins of the conventional heat exchanger are provided with transparent hydrophilic coating after they are washed; therefore, the color of the surfaces is silver, which is extremely close to white (hereinafter referred to as "white").

The white color has high reflectance of light and therefore lowers the heat conductivity based on the wavelength of reflected light, i.e. heat ray, making it difficult to improve the heat radiation of the fins. Thus, the heat radiation from the fins is lowered, thus adversely affecting the condensation of the refrigerant in the heat exchanger. This adds to the difficulty in achieving an improved cooling capability of the refrigerating cycle.

Although the aforesaid problem is not as remarkable as in the case of a condenser, the same problem is observed when the heat exchanger is used for a cooler or evaporator. More specifically, as the reflectance of light increases, the absorption of heat by the ambient air deteriorates.

A means for improving the performance of a heat exchanger has been disclosed in, for example, Japanese Patent Publication No. 4-21117 (F28F1/40). According to the disclosure, the inner surface of a refrigerant pipe is provided with many helical grooves, so that a refrigerant flows along the grooves from the capillary action all the way up to the top of the pipe to ensure heat exchange between the refrigerant and the refrigerant pipe over an extended area, or over the entire area ideally, of the inner surface of the pipe, thereby improving the heat transfer characteristic.

When a refrigerant composed of a mixture of two or more types of refrigerants is used as the refrigerant flowing through the refrigerant pipe, the respective ingredient refrigerants exhibit different properties, especially different viscosities. The grooves in the conventional refrigerant pipe, however, all had the same width; therefore, when the refrigerant is in the gas-liquid mixture condition and the rate of flow liquid in the refrigerant is small, setting the grooves to a small width for a refrigerant with low viscosity presents a problem in that the width is too small for a refrigerant with high viscosity and the flow resistance increases, leading to a large pressure loss. The result is stagnation of the refrigerant with high viscosity. Conversely, setting the grooves to a larger width so as to match it to a refrigerant with high viscosity poses a problem in that the grooves are too wide for a refrigerant with low viscosity and the capillary action no longer works.

SUMMARY OF THE INVENTION

The present invention has been accomplished with a view toward solving the problems with the prior art stated above and it is an object of the present invention to improve the capability of a heat exchanger employed for a refrigerating cycle.

To this end, a heat exchanger according to the present invention is used for a refrigerating unit which is constructed with at least a compressor, a heat source side heat exchanger, an expansion device, a user side heat exchanger and other devices, which are all linked so that a refrigerant discharged from the compressor is circulated therethrough. At least one of the heat exchangers has a pipe, through which a refrigerant flows, and fins installed on the pipe to provide heat conductivity. The inner surface of the pipe is provided with a plurality of grooves formed in the flow direction of the refrigerant. At least two types of grooves, which differ in width, are used.

The grooves formed in the inner surface of the pipe are formed helically in the flow direction of the refrigerant.

Further, the refrigerant circulated through the refrigerating cycle has at least two different ingredients and the aforesaid pipe has at least one groove suited for one of the ingredients.

The present invention makes it possible to permit the heat exchange between the refrigerant and the pipe over an extended area of the inner surface of the pipe by the capillary action, while controlling at the same time the increase in the pressure loss caused by the circulating resistance of the refrigerant even when a mixed refrigerant of two or more different ingredients flows through the pipe. The present invention also makes it possible to control the variations in the mixing ratio of the mixed refrigerant when the mixed refrigerant flows through the pipe.

The grooves, which are formed helically in the flow direction of the refrigerant, further add to the improvement of the heat transfer between the refrigerant and the pipe.

The fins of the heat exchanger in accordance with the present invention are provided with a paint prepared by mixing a hydrophilic paint and a material, which has the properties similar to those of a blackbody, so as to provide lower reflectance of light.

The hydrophilic paint is composed of a hydrophilic organic resin and a silica complex; the material having the properties similar to those of a blackbody is a carbon black pigment or cuprous oxide. The material having the properties similar to those of a blackbody is added to the hydrophilic paint in a ratio of five percent.

FIG. 4 shows the relationship between the reflectance of light and the color of the surfaces of the fins of the heat exchanger used for this type of refrigerating cycle. In the graph, B1 denotes the reflectance at the wavelength of a white surface color of the fins; B2 denotes the reflectance at the wavelength of a grey surface color of the fins; and B3 denotes the reflectance at the wavelength of a black surface color of the fins. The aforesaid white, grey, and black colors can be expressed in terms of L value (light:+←L value→−:dark), "a" value (red:+←a value→−:green), and "b" value (yellow:+←b value→−: blue) by using a Minolta color difference meter CR-200 as follows: white is expressed by L value=89.2, "a" value=−0.8, "b" value=+1.5; grey is expressed by L value=75.7, "a" value=0.0, "b" value=+3.8; and black is expressed by L value=52.5, "a" value=+0.7, and "b" value =+5.3.

When the heat exchanger is used as a condenser, the temperature thereof rises to +20 to +100 degrees centigrade as previously mentioned and the wavelength of the heat rays radiated from the surfaces of the fins ranges from 2000 to 20000 angstroms according to the temperature thereof. As is obvious from the graph of FIG. 4, the reflectance becomes lower as the color of the fins comes closer to black in such a wavelength range. In particular, at a wavelength of 9000 angstroms or less, the light reflectance of the fins with the black surface is low.

According to the present invention, the heat radiation from the surface of a heat exchanger can be remarkably improved. Thus, the heat exchanger can be made smaller and the cooling or heating capability of the refrigerating cycle can be improved.

DESCRIPTION OF THE PREFERRED EMBODIMENTS

Figure 1:
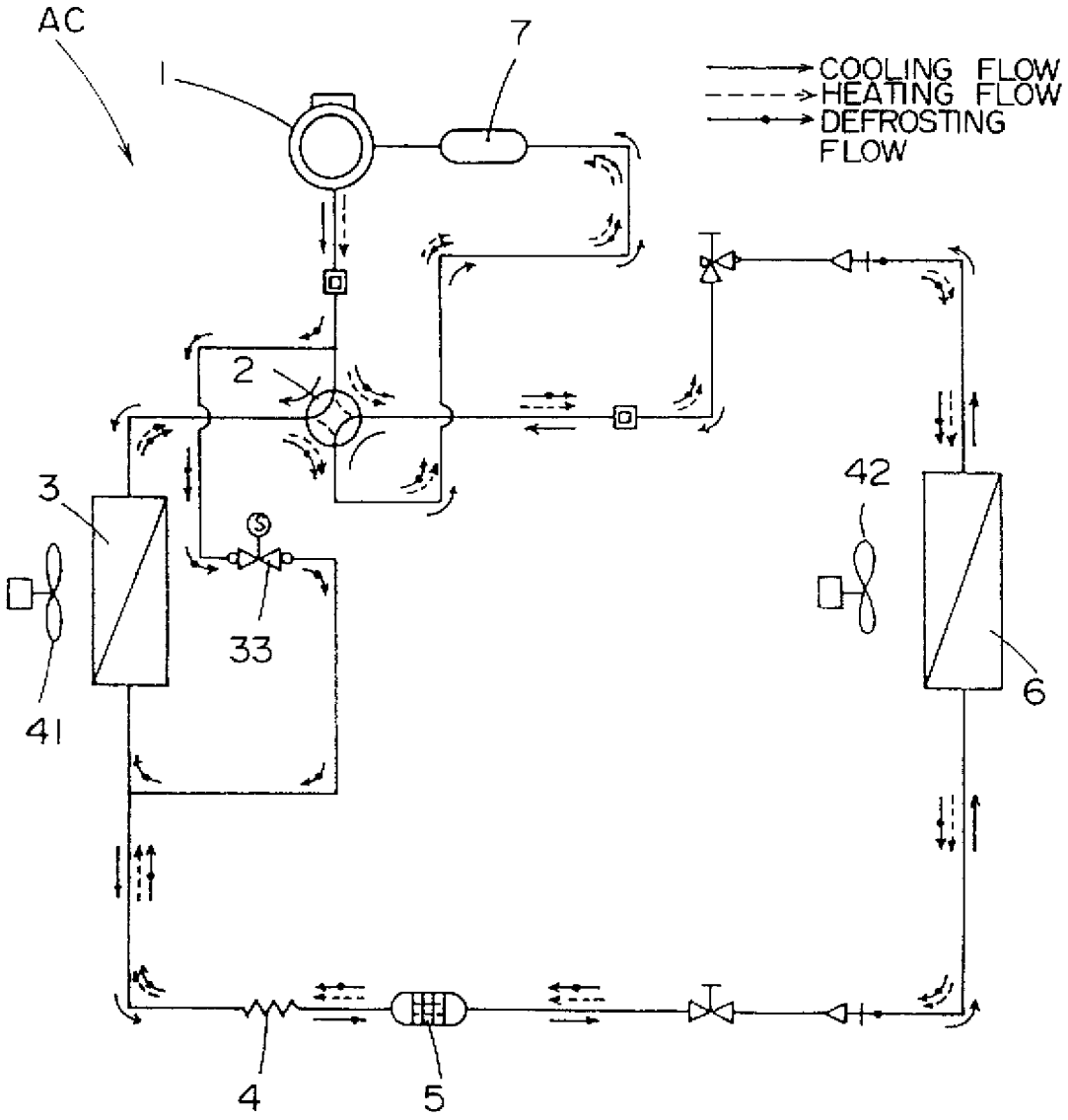
FIG. 1 is a circuit diagram of a refrigerant of an air conditioner which is an embodiment of the present invention.

An embodiment of the present invention will now be described. FIG. 1 shows the refrigerant circuit diagram of an air conditioner AC which is an embodiment to which the present invention applies. Air conditioner AC shown in FIG. 1 includes a compressor 1, a four-way valve 2, a heat source side heat exchanger 3 serving as an outdoor heat exchanger, a capillary tube 4 serving as an expansion device, a modulator 5 with screen, a user side heat exchanger 6, and an accumulator 7 which are all linked by a refrigerant pipe to configure a refrigerant cycle. Blowers 41 and 42 blow air to the heat source side heat exchanger 3 and the user side heat exchanger 6, respectively, to promote the heat exchange with air.

Different refrigerants and oils are sealed in the refrigerant circuit according to the evaporating temperature, i.e. application. For instance, high-temperature equipment such as air conditioner AC in this embodiment uses a sole refrigerant R22 or an HFC-based mixed refrigerant containing R134*a*, e.g. a mixed refrigerant composed of three types, namely, R134*a*, R32, and R125 (the composition of the refrigerant is, for example, 52 wt % of R134*a*, 23 wt % of R32, and 25 wt % of R125), or a mixed refrigerant composed of R32 and R125 (the composition of the refrigerant is, for example, 50 wt % of R32 and 50 wt % of R125, or a mixture of the two of approximately the same percentage by weight). The oils to be used with the refrigerants are of polyol ester type, alkyl benzene type, or other type which is compatible with the refrigerants.

The embodiment to be discussed below is assumed to use a mixed refrigerant composed of R134*a*, R32, and R125. The characteristics of these three refrigerants are as follows: R134*a* has a boiling point of −26 degrees centigrade and a viscosity of 0.204 mPa·S; R32 has a boiling point of 53 degrees centigrade and a viscosity of 0.140 mPa·S; and R125 has a boiling point of −48.3 degrees centigrade and a viscosity of 0.145 mPa·S.

Figure 2:
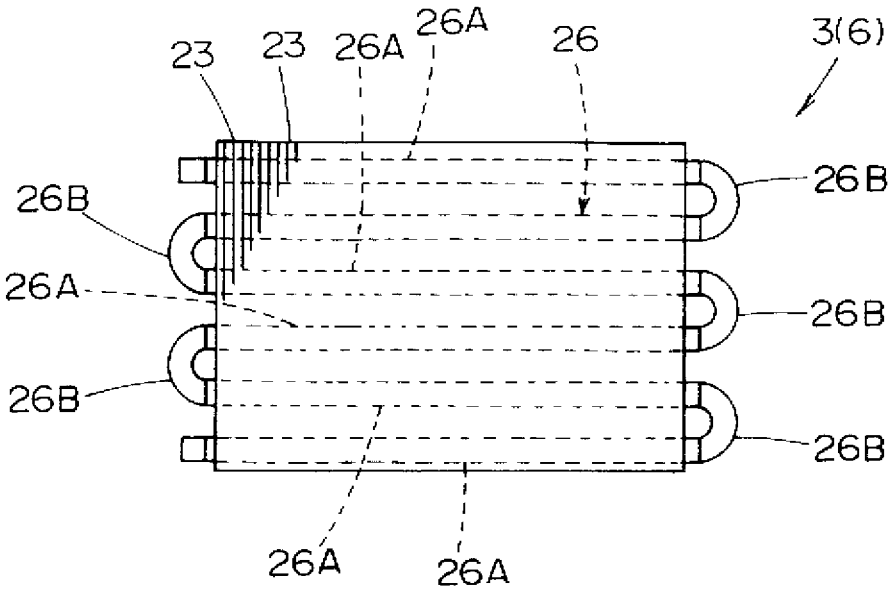
FIG. 2 is a front view showing a heat exchanger of an air conditioner shown in FIG. 1.
Figure 3:
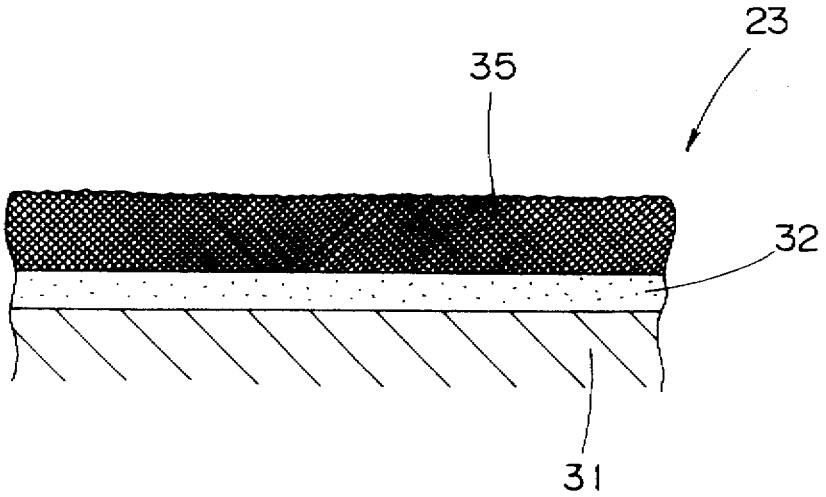
FIG. 3 is an enlarged cross-sectional view of the surfaces of the fins of the heat exchanger shown in FIG. 2.

The heat source side heat exchanger 3 is constituted by a plurality of plate-shaped fins 23, which are disposed with predetermined intervals provided among them as illustrated in FIG. 2, and a snaking refrigerant pipe 26 which penetrates the fins 23 in such a manner that it permits heat exchange.

The fins 23 are composed of a thin plate 31 which is made of aluminum,including an aluminum alloy, and which measures 100 to 120 microns thick. The surface of each fin 23 is provided with a rustproof layer 32, which is about two microns thick, by immersing the aluminum thin plate 31 in an acid solution (e.g. chromic acid, chromate, bichromate, chromic acid/phosphoric acid, and phosphoric acid).

The outer side of the rustproof layer 32 is provided with a coat of a hydrophilic film 35 which is 5 to 10 microns thick. The hydrophilic film 35 is provided to make it difficult for water droplets, which lead to circulation resistance, to be formed on the surfaces of the fins 23. The hydrophilic film 35 according to the present invention is composed of a mixture of hydrophilic paint, water, and a material having properties similar to those of a blackbody.

In this embodiment, the hydrophilic paint is composed of acrylic resin or hydrophilic organic resin and a silica complex. It is assumed that the blackbody absorbs all light and therefore reflects no light. The material which exhibits the properties similar to those of the blackbody is selected from among carbon black type pigments or cuprous oxides.

The water is used to ensure easy handling of the paint; it evaporates after painting has been completed.

The paint in this embodiment is prepared by mixing 100 grams of the aforesaid hydrophilic organic resin and silica complex, or acrylic resin, 3000 grams of water, and 5 grams of the carbon black type pigment, that is, 5% of the carbon black type pigment with respect to the hydrophilic paint.

The fins 23 provided with the rustproof layer 32 are washed, immersed in the aforesaid paint and drawn up, then they are dried and baked to form the hydrophilic film 35 thereon. Since the water evaporates, the mixing ratio need not be very strict.

Figure 4:
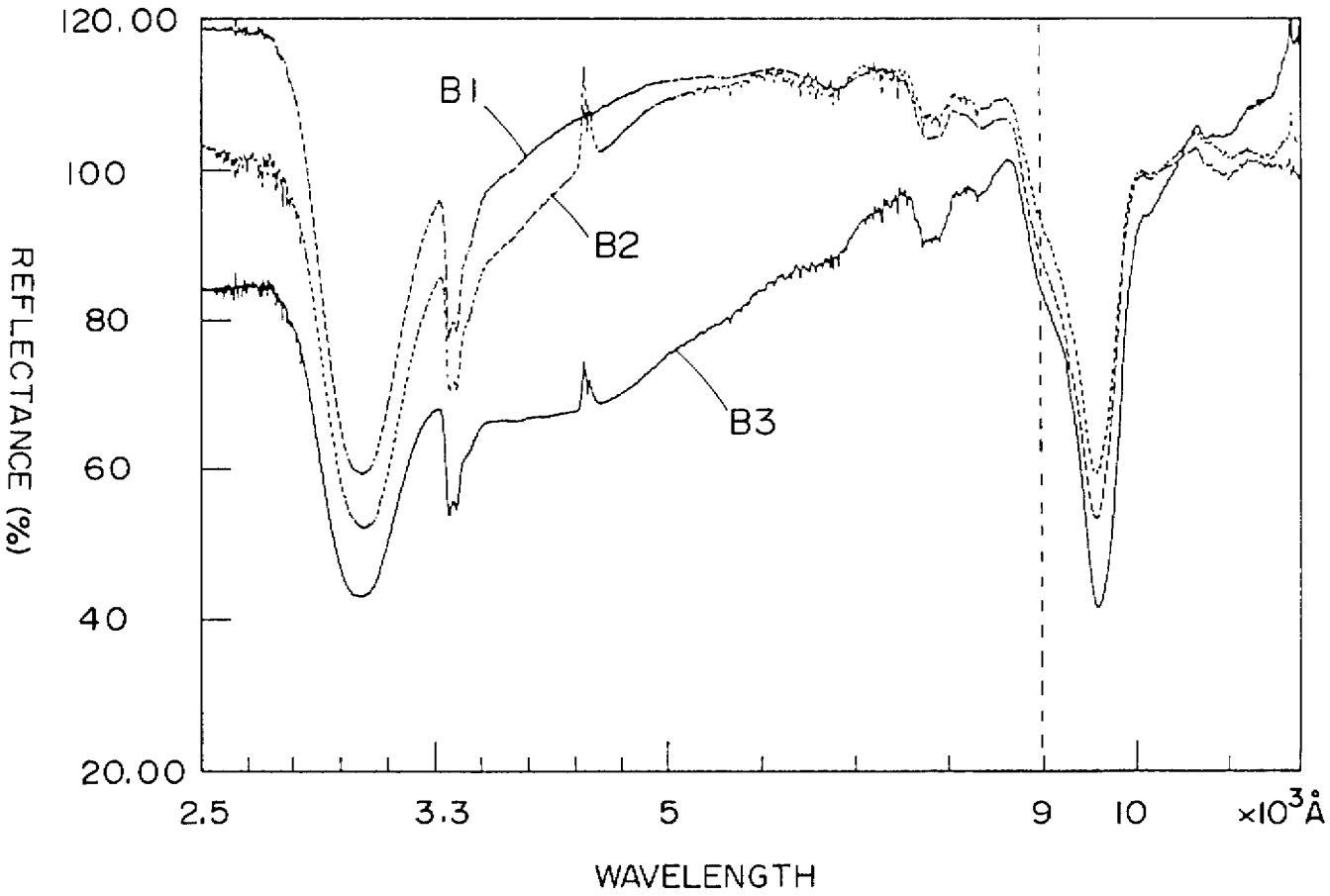
FIG. 4 is a graph showing the relationship between the colors of the surfaces of the fins of the heat exchanger and the corresponding reflectances of light.

The formation of the hydrophilic film 35 makes the surfaces of the fins 23 black, the characteristic of which is B3 (L value=52.5; "a" value=+0.7; "b" value=+5.3) shown in FIG. 4. The heat exchanging performance of the heat exchanger can be improved if the reflectance of light of the black on the fins 23 is lower than that of B2 shown in FIG. 4.

Holes for inserting the pipe are formed in the fins 23 beforehand and the fins 23 are set into a plurality of straight pipes 26A constituting the refrigerant pipe 26 at predetermined intervals. Pressure is applied from inside of the straight pipes 26A to expand the pipes, then bent pipes 26B are welded so as to be communicated with the respective straight pipes 26A. Thus, the snaking refrigerant pipe 26 is configured and the heat exchanger 3 is completed.

Figure 5:
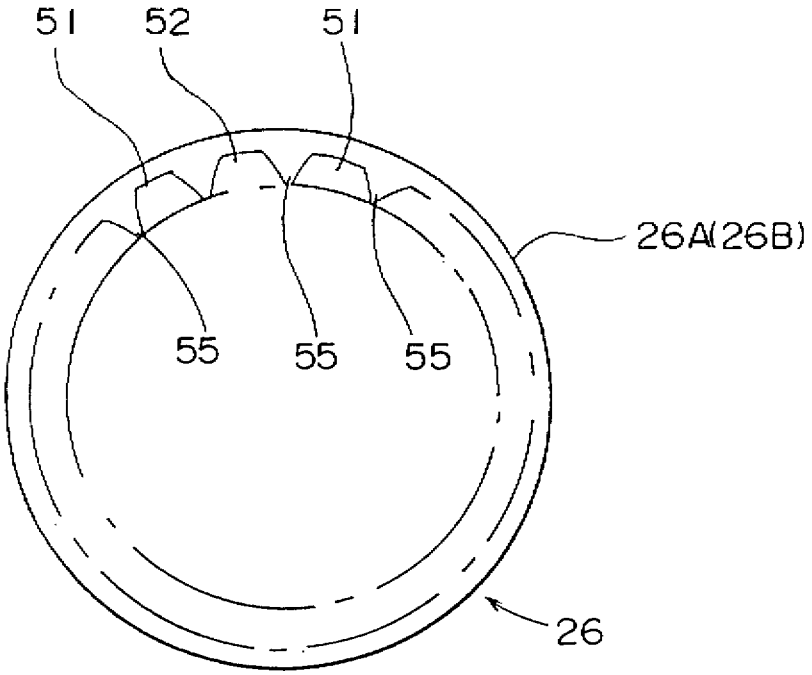
FIG. 5 is a cross-sectional view of a refrigerant pipe of the heat exchanger shown in FIG. 2.
Figure 6:
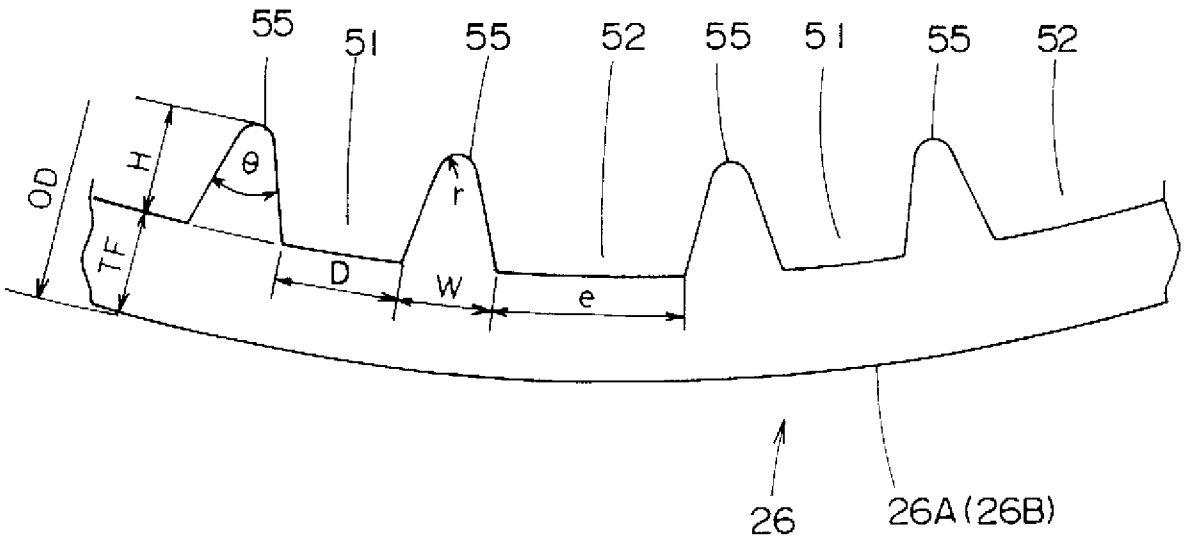
FIG. 6 is a partially enlarged cross-sectional view of the refrigerant pipe of the heat exchanger shown in FIG. 2.

FIG. 5 is the cross-sectional view of the straight pipes 26A (the same view applies to the bent pipes 26B) constructing the refrigerant pipe 26; FIG. 6 is the partially enlarged cross-sectional view of FIG. 5. The inner surface of the straight pipe 26A is provided with, for example, a total of sixty grooves 51 . . . and 52 . . . , bottom width D of the groove 51 is set to 0.33 mm, for example, and bottom width "e" of the groove 52 is set to 0.48 mm, for example, which is a larger value than D. Thus the grooves 51 and 52 are alternately disposed.

For instance, height H of a ridge 55 separating the grooves 51 and 52 is set to 0.3 mm, apex angle θ to 30 degrees, and tip curvature r to 0.05 mm. The twisting angle for helically disposing the grooves 51 and 52 is 18 degrees, for instance. The outer diameter OD of the straight pipes 26A is set to e.g. 10 mm and the bottom thickness TF thereof is set to e.g. 0.27 mm.

The user side heat exchanger 6 has the same structure as the heat source side heat exchanger 3; therefore, the description thereof will be omitted. Further, the fins are not restricted to the plate shape (the plate-shaped fins are commonly known as plate fins); spiral fins or fins of other shapes may be used instead.

In the cooling operation mode, in air conditioner AC having the aforesaid configuration, the mixed refrigerant flows in the order of the compressor 1, the four-way valve 2, the heat source heat exchanger 3, the capillary tube 4, the modulator 5 with screen, the user side heat exchanger 6, and the accumulator 7 as indicated by the solid line arrows in FIG. 1. In this case, the gas refrigerant, which is a mixed refrigerant of high temperature and high pressure discharged from the compressor 1, flows into the heat source heat exchanger 3, radiates the heat thereof into the air, and condenses. The refrigerant is then reduced in pressure through the capillary tube 4 before it flows into the user side heat exchanger 6 and evaporates (endothermic action). Thus, the heat source side heat exchanger 3 functions as a condenser and the user side heat exchanger 6 functions as a cooler.

Air is supplied by the blower 41 from outside to the heat source side heat exchanger 3 at a velocity of about 1 m/s. The warm air resulting from the heat exchange with the heat source side heat exchanger 3 is radiated into the air. As previously stated, the fins 23 of the heat source side heat exchanger 3 are provided with the hydrophilic film 35 colored with the black which exhibits low reflectance of light, thus enabling remarkably improved heat radiation from the fins 23. This makes it possible to reduce the size of the heat source side heat exchanger 3 for securing a required condensing capability. In other words, the heat exchanger 3 of the same size having the configuration permits improved cooling capability of air conditioner AC owing to the improved condensing capability.

Likewise, the cool air produced by the heat exchange with the user side heat exchanger 6 is supplied to the user by the blower 42. As previously mentioned, since the fins 23 of the user side heat exchanger 6 are also provided with the hydrophilic film 35 colored with the black which exhibits low reflectance of light, there is improved heat absorption from the fins 23. This makes it possible to reduce the size of the user side heat exchanger 6 for securing a required heat absorbing capability, i.e. cooling capability. In other words, the heat exchanger 6 of the same size having the aforesaid configuration permits improved cooling capability of air conditioner AC owing to the improved heat absorbing capability, i.e. cooling capability.

When the rate of flow of liquid in the refrigerant is great, the mixed refrigerant flowing into the heat source side heat exchanger 3 and the user side heat exchanger 6 is stirred by the spiral grooves 51 and 52, and when the rate of liquid flow in the refrigerant is small, the mixed refrigerant flowing into the heat source side heat exchanger 3 and the user side heat exchanger 6 helically moves by the capillarity along the grooves 51 and 52 which are matched to the properties of the respective ingredient refrigerants and which are formed in the inner wall of the refrigerant pipe 26, preventing any particular ingredient refrigerant from becoming stagnant. As mentioned above, R32 and R125 have low viscosity, whereas R134*a* has high viscosity; therefore, R134*a* with high viscosity flows primarily through the grooves 52 which are wide, while R32 and R125 flow primarily through the grooves 51 which are narrow.

Hence, the capillarity substantially decreases the circulating resistance of R134*a* with a consequent decreased pressure loss, thus ensuring smooth flow of the mixed refrigerant to the upper portion in the refrigerant pipe 26 (straight pipes 26A and bent pipes 26B). Likewise, R32 and R125 smoothly flow to the upper portion in the refrigerant pipe 26 along the grooves 51.

The configuration described above enables the respective ingredient refrigerants to smoothly flow along the grooves 51 or 52 which differ in width to match to the properties, especially the viscosities, of the respective ingredient refrigerants. Therefore, the heat exchange between the refrigerant and the refrigerant pipe 26 takes place over the extended area of the inner surface of the refrigerant pipe 26, thus achieving improved heat transfer characteristic. In this case, therefore, the heat radiation, i.e. condensing performance, can be further improved in the heat source side heat exchanger 3; and the heat absorbing characteristic, i.e. cooling characteristic, can be improved also in the user side heat exchanger 6, leading to improved cooling capability of air conditioner AC.

Using such a refrigerant pipe, which has grooves of different widths, as the refrigerant pipes for connecting the respective devices in a refrigerating cycle provides almost the same result in the pressure loss of each of the respective ingredient refrigerants of a mixed refrigerant circulating in the refrigerating cycle. Hence, the differences in the pressure loss among the individual refrigerants cause a particular refrigerant to accumulate in a part in the refrigerating cycle, suppressing the undesirable changes in the mixing ratio of the mixed refrigerant which circulates in the refrigerating cycle.

In the heating operation mode, as indicated by dashed arrows in FIG. 1, the mixed refrigerant flows in the order of the compressor 1, the four-way valve 2, the user side heat exchanger 6, the modulator 5 with screen, the capillary tube 4, the heat source side heat exchanger 3, and the accumulator 7. In this case, the gas refrigerant, i.e. the mixed refrigerant, discharged from the compressor 1 flows into the user side heat exchanger 6 and it is radiated and condensed; it is then reduced in pressure through the capillary tube 4 before flowing into the heat source side heat exchanger 3 where it evaporates. Thus, the heat source side heat exchanger 3 functions as the cooler and the user side heat exchanger 6 functions as the condenser.

As stated above, air is supplied by the blower 42 to the user side heat exchanger 6. The warm air produced by the heat exchange with the user side heat exchanger 6 is circulated to a room where a user is located. As previously stated, the fins 23 of the user side heat exchanger 6 are provided with the hydrophilic film 35 colored with the black pigment which exhibits low reflectance of light, thus enabling remarkably improved heat radiation from the fins 23. This makes it possible to reduce the size of the user side heat exchanger 6 for securing a required heating capability. In other words, the user side heat exchanger 6 of the same size having the configuration permits improved heating capability of air conditioner AC.

Likewise, the cool air resulting from the heat exchange with the heat source side heat exchanger 3 is radiated outside by the blower 41. As previously mentioned, since the fins 23 of the heat source side heat exchanger 3 are also provided with the hydrophilic film 35 colored with the black pigment which exhibits low reflectance of light, the heat absorption from the fins 23 can be improved. This makes it possible to reduce the size of the heat source side heat exchanger 3 for securing a required heat absorbing capability. In other words, the heat exchanger 3 of the same size having this configuration permits improved heating capability of air conditioner AC owing to the improved heat absorbing capability.

Furthermore, the heat transfer characteristic of both heat exchangers 3 and 6 can be improved. In the user side heat exchanger 6, the heat radiation characteristic, i.e. heating performance, can be further improved; and in the heat source side heat exchanger 3, the heat absorbing characteristic can be improved, thereby improving the heating capability of air conditioner AC.

In the defrosting operation mode, as indicated by the solid arrows with dots in FIG. 1, the operating refrigerant flows in the order of the compressor 1, the four-way valve 2, the user side heat exchanger 6, the modulator 5 with screen, the capillary tube 4, the heat source side heat exchanger 3, the four-way valve 2, and the accumulator 7. A solenoid valve 33 is open and therefore, a part of the refrigerant flows through the compressor 1, the solenoid valve 33, and the heat source side heat exchanger 3, thereby defrosting the heat source side heat exchanger 3 while maintaining the heating operation.

In the embodiment, the mixed refrigerant composed of three different refrigerants is used and the grooves of two different widths are formed in the inner surface of the refrigerant pipe. The refrigerant, however, may alternatively be a mixture of two types of refrigerants or a mixture of other types of refrigerants. In such a case, grooves having widths matched to the properties, especially the viscosities, of the respective refrigerants are to be formed. The air conditioner has been taken as an example in this embodiment, however, the present invention is not limited thereto. The present invention can be effectively applied also to a refrigerator, a cooled showcase, etc.

Thus, according to the present invention, even when a mixed refrigerant composed of two or more different refrigerants flows through a refrigerant pipe of a heat exchanger, the capillary action enables the heat exchange between the refrigerant and the refrigerant pipe to be implemented over a larger area of the inner surface of the pipe while controlling the increase in the pressure loss caused by the circulating resistance of the respective ingredient refrigerants, thus achieving an improved heat transfer characteristic. Furthermore, by utilizing the capillary action based on the groove widths, the difference in the pressure loss caused by the different circulating resistances of the respective ingredient refrigerants is controlled so as to control the fluctuations in the mixing ratio of the mixed refrigerant when the mixed refrigerant flows through the refrigerant pipe.

Moreover, the heat radiation from the surface of the heat exchanger can be significantly improved; therefore, the heat exchanger can be made smaller and also the cooling or heating capability of the refrigerating cycle can be improved.

What is claimed is:

1. A heat exchanger used for a refrigerating cycle comprising a compressor, a hear source side heat exchanger, an expansion device, and a user side heat exchanger which are linked to circulate at least two refrigerants, each having a different viscosity characteristic, discharged from the compressor; wherein at least one of said heat exchangers has a pipe through which the refrigerants flow, and a fin which has a heat transfer characteristic and which is mounted on the pipe; and the inner surface of said pipe having a plurality of helical grooves formed in the direction in which the refrigerants flow, each of said plurality of grooves being formed along its length by ridges of the same shape having walls that diverge from an apex into the groove bottom, said grooves are of the same depth, and said plurality of grooves having respective bottoms of at least two respectively different widths each matched to the viscosity of a refrigerant with increasing width corresponding to a higher viscosity.

2. A heat exchanger used for a refrigerating cycle according to claim 1, wherein said fin is coated with a paint comprising a mixture of a hydrophilic paint of a hydrophilic organic resin and a silica complex, and a material having properties similar to those of a blackbody and formed from a carbon black type pigment or a cuprous oxide at a predetermined ratio to provide low reflectance of light.

3. A heat exchanger used for a refrigerating cycle according to claim 2, wherein said material having properties similar co the blackbody is mixed at a ratio of 5% in relation to the hydrophilic paint.

* * * * *

UNITED STATES PATENT AND TRADEMARK OFFICE

CERTIFICATE OF CORRECTION

PATENT NO. : 5,862,857

DATED : Jan. 26, 1999

INVENTOR(S) : Atsuyumi ISHIKAWA et al.

It is certified that error appears in the above-identified patent and that said Letters Patent is hereby corrected as shown below:

On title page,[75] Inventors, please correct the place of residence of TAKASHI KAWANABE and MASAYUKI MOTEGI.
"OIZUMI, JAPAN" should be --ORA-GUN, JAPAN--.

Signed and Sealed this

Tenth Day of August, 1999

*Attest:*

Q. TODD DICKINSON

*Attesting Officer*

*Acting Commissioner of Patents and Trademarks*